United States Patent [19]

Shichijo

[11] 4,372,090

[45] Feb. 8, 1983

[54] STRUCTURE FOR ROOFING TILE

[76] Inventor: Kojiro Shichijo, 2-3-45-731 Tsurumi, Tsurumi-ku, Yokohama, Kanagawa, Japan

[21] Appl. No.: 313,323

[22] Filed: Oct. 20, 1981

[51] Int. Cl.[3] ..... E04D 1/00; B32B 3/30

[52] U.S. Cl. ..... 52/536; 52/518; 52/539; 52/542; 428/167; 428/174; 428/192

[58] Field of Search ..... 428/167, 174, 53, 192; 52/536, 518, 539, 542, 558

[56] References Cited

U.S. PATENT DOCUMENTS 1,395,423 11/1921 Joseph ..... 52/536

FOREIGN PATENT DOCUMENTS 1386138 12/1974 France ..... 52/536

*Primary Examiner*—Paul J. Thibodeau

*Attorney, Agent, or Firm*—Koda and Androlia

[57] ABSTRACT

A roofing tile having on its bottom surface a rear edge flange, a pair of stabilizing pawls and a plurality of longitudinal ribs, said tile also having along its front edge bottom surface a lateral rib and further having projections on its lateral rib and recesses on its rear edge flange; said tile is able to be supported on a shingle by said stabilizing pawls and longitudinal ribs and is also stabilized by engaging the projections with the recesses of a subjacent tile, as a result the tile may distribute given load to several supporting points, preventing itself from being cracked and also may be installed regularly with ease without being disordered.

3 Claims, 9 Drawing Figures

FIG. 3
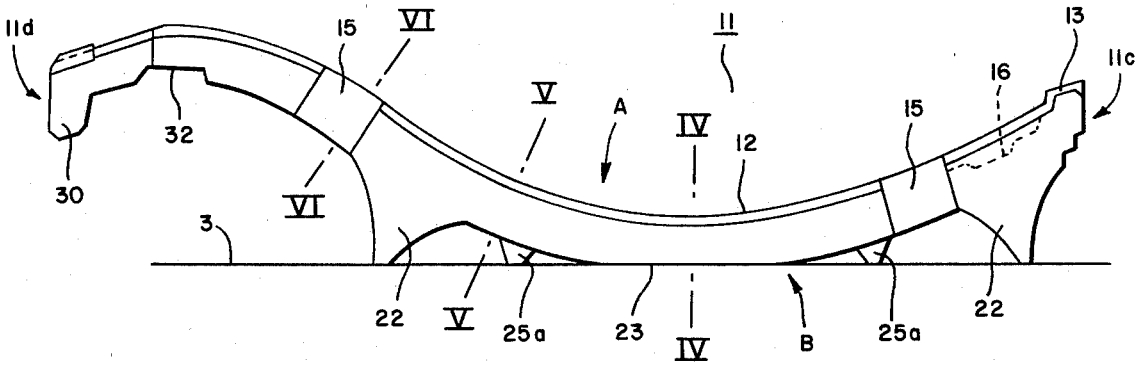
FIG. 4
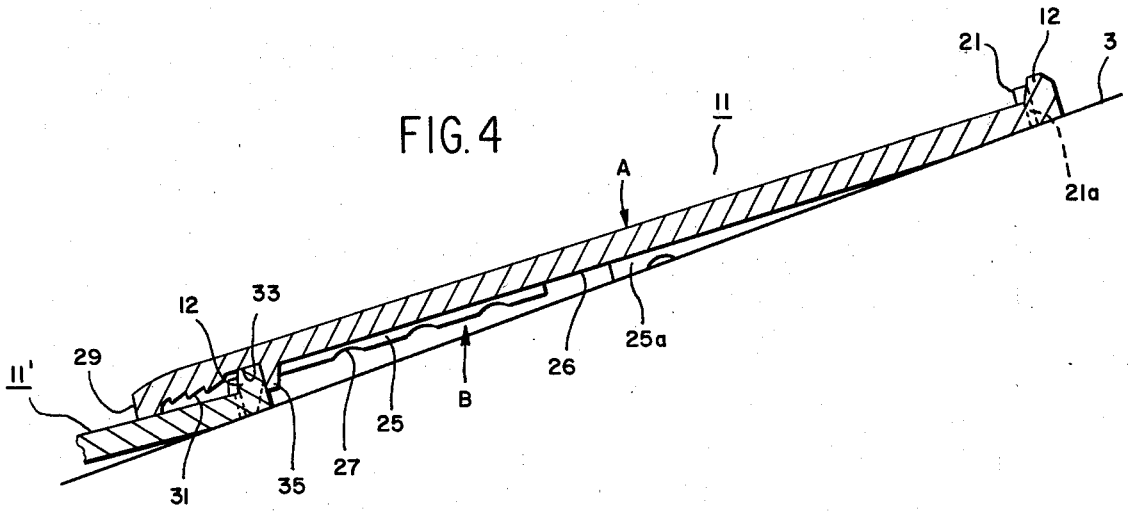
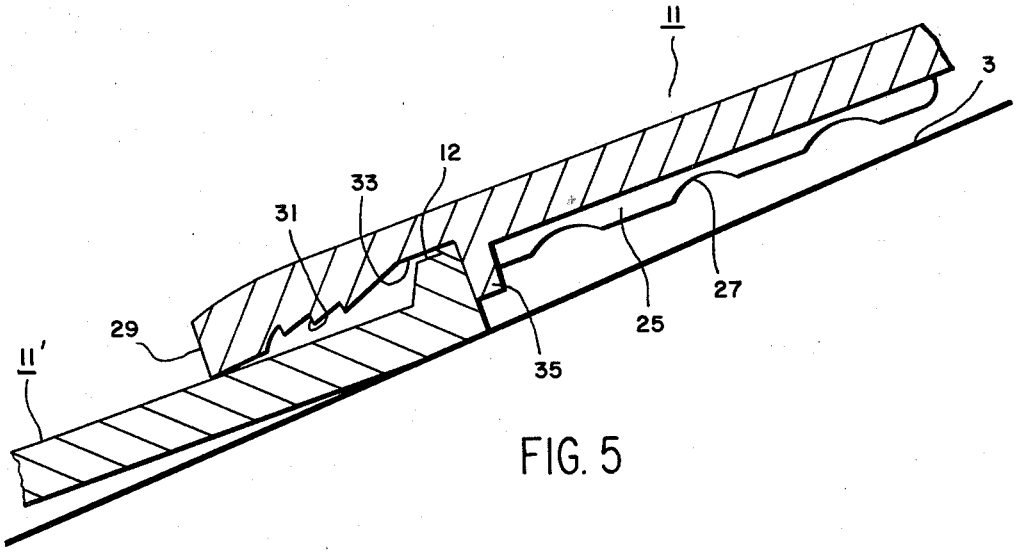
FIG. 5

FIG. 6
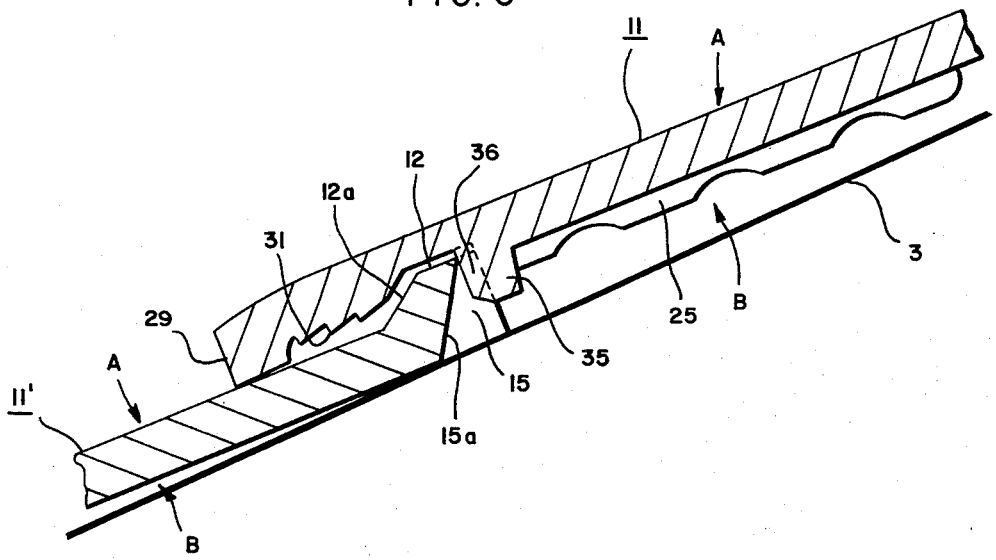
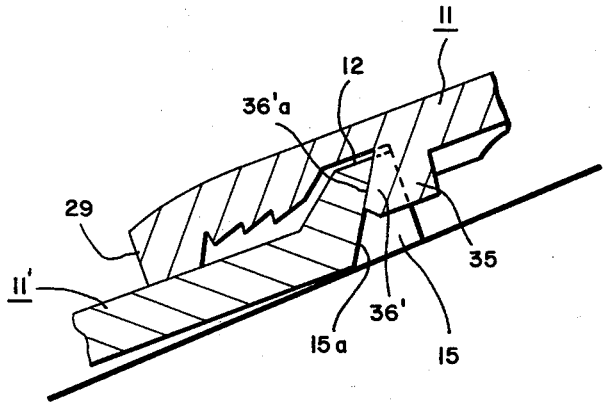
FIG. 7

PRIOR ART

STRUCTURE FOR ROOFING TILE

BACKGROUND OF THE INVENTION

1. Field of the Invention

This invention relates to a roofing tile and more particularly to the configurational structure of a roofing tile.

2. Prior Art

In the prior art, the most typical roofing tile, as is shown in FIG. 9, is provided at its rear edge 1*a* with a hooking pawl 2. Such roofing tile is installed on a roof in such a manner that the roofing pawl 2 is hooked by a cross-piece 5 nailed on a shingle 3 and a front edge 1*b* of the tile 1 is overlapped on the top surface of a subjacent tile 1' and then nails are driven through the tile 1 into a cross-piece 5 to prevent the tile 1 from slipping down.

Therefore, installation of the roofing tile of the type described above is troublesome, requiring a long time of roofing work. Moreover, rainwater flowing from the roofing tile into the shingle 3 is blocked by the cross-piece 5 and collects around it; as a result it flows through nail-holes into the attic, causing leakage.

On the other hand, since the roofing tile 1 is supported by rear edge 1*a* and front edge 1*b* and also by the relatively narrow area of the trough of the S-shaped curve of the tile, the tile is, when a man steps on it, given a large amount of bending force which might cause it to crack.

Further, because of the above-mentioned relatively weak supporting structure, the roofing tiles installed on the roof cannot be sufficiently stable; as a result, when a man walks on the installed roofing tiles, there is always a risk of causing cracks or disorder to the tiles.

SUMMARY OF THE INVENTION

Accordingly, it is a general object of the present invention to eliminate drawbacks of the prior art roofing tile.

It is another object of the present invention to provide a roofing tile which is able to distribute load given thereon to several points to prevent the tile from being cracked or disordered.

It is still another object of this invention to provide a roofing tile which may be installed without using cross-pieces to eliminate the cause of leakage of rain.

The above-mentioned features and objects of the present invention are accomplished by a unique roofing tile. The bottom surface of the tile is provided with stabilizing pawls spaced at a fixed distance on its rear edge, a plurality of longitudinal ribs and a lateral rib along the front edge of the tile, and the tile is further provided with inlaying projections on said lateral rib and receiving recess on the rear edge of the tile such that when the roofing tile is installed on a roof, the stabilizing pawls and at least the rear portions of the longitudinal ribs may come in contact with a shingle to support the tile and said lateral rib makes contact with the rear edge of a subjacent tile to engage the inlaying projections with the receiving recess, keeping the regularity of the installed tiles.

BRIEF DESCRIPTION OF THE DRAWINGS

The above-mentioned features and objects of the present invention will become more apparent with reference to the following description taken in conjunction with the accompanying drawings wherein like reference numeral denote like elements; and in which:

FIG. 3 is a top plan view showing the rear edge of the tile installed;

FIG. 4 is a cross-sectional view taken along the line IV—IV of FIG. 3;

FIG. 5 is a cross-sectional view taken along the line V—V of FIG. 3;

FIG. 6 is a cross-sectional view taken along the line VI—VI of FIG. 3;

FIG. 7 is a cross-sectional view partially showing the modified embodiment of the invention;

DETAILED DESCRIPTION OF THE INVENTION

Figure 1:
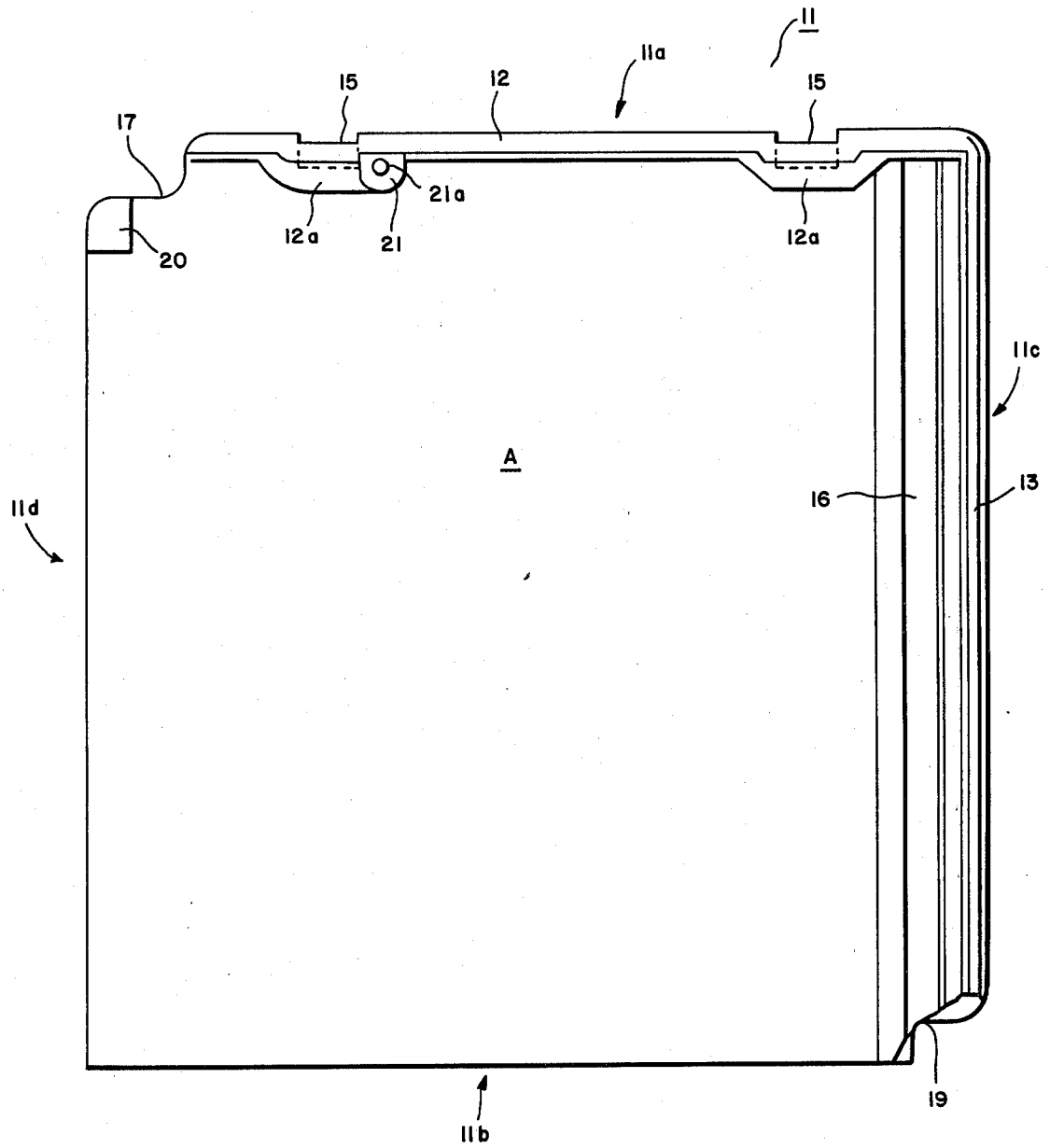
FIG. 1 is a top plan view of a roofing tile in accordance with the teachings of the present invention.

Referring more particularly to the Figures, a roofing tile 11 of this invention is substantially rectangular in shape when viewed from above as is shown in FIG. 1 and is substantially S-shaped in cross section as seen in FIG. 3.

On the top surface A of the roofing tile 11 are provided upwardly flanges 12 and 13, which form a drain along its rear edge 11*a* and flat side edge 11*c*, respectively. The rear edge flange 12 provided along the rear edge 11*a* has at its both sides engaging recesses 15. The engaging recesses 15 are, as is shown specifically in FIG. 6, designed in such a manner that they gradually increase their notching depth from the top surface A to the bottom surface B, forming backwardly-inclined surfaces 15*a*. The rear edge flange 12 also has inclined surfaces 12*a* at the portions adjacent the engaging recesses 15.

On the top surface A along the flat side flange 13 which is provided on the flat side 11*c* is formed a shallow groove 16 having a fixed width. The roofing tile 11 is further provided with notched portions 17 and 19 in opposite corners of the tile, that is, along a diagonal line thereof; and a recess 20 is also provided on the top surface A adjacent to the notched portion 17.

The reference numeral 21 in FIG. 1 denotes a projection having a nail hole 21*a* in it.

Figure 2:
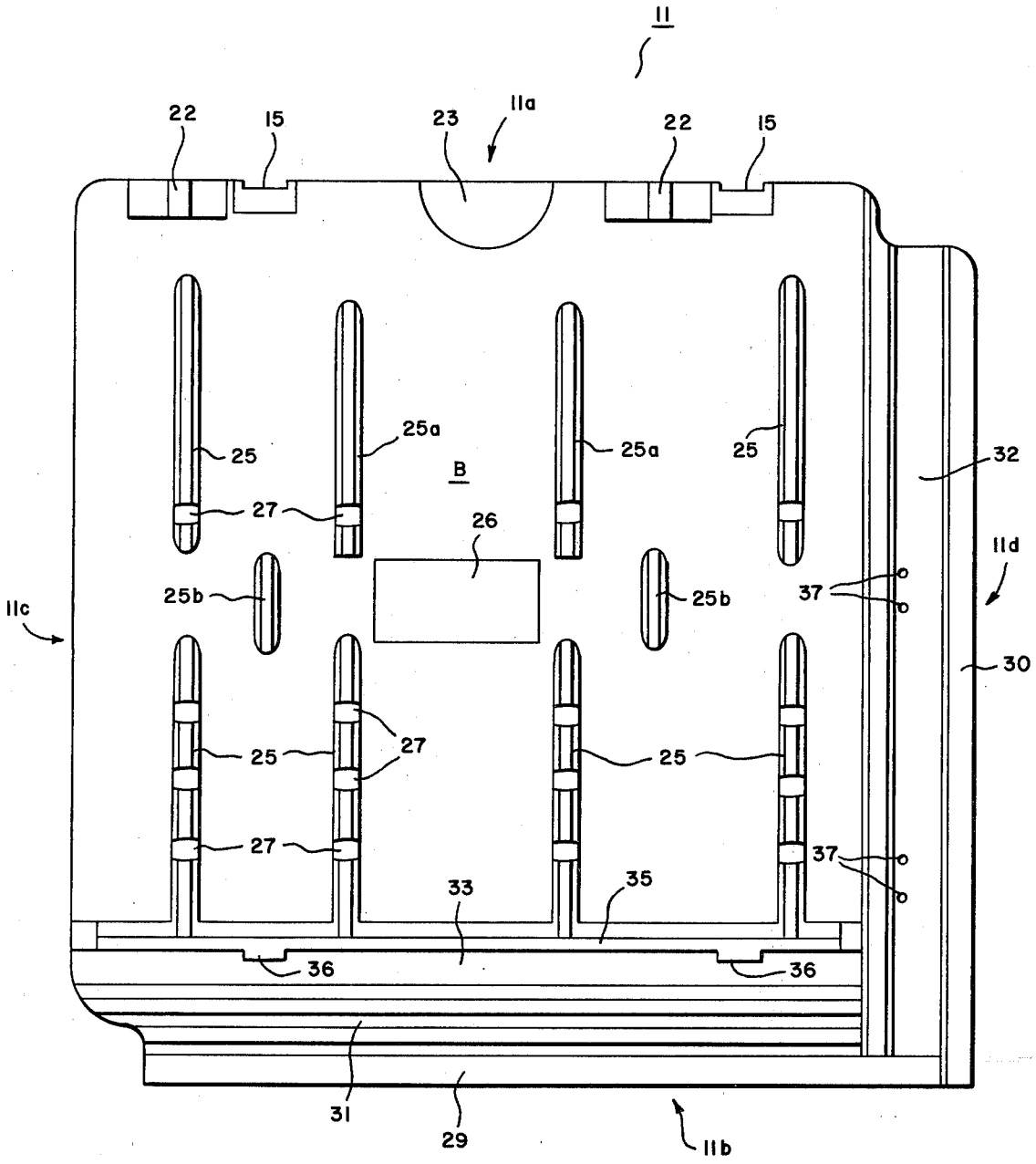
FIG. 2 is a bottom plan view thereof.

On the other hand, at both sides of the rear edge portion 11*a* on the bottom surface B are, as shown in FIGS. 2 to 4, provided with stabilizing pawls 22, whose height is determined so that when the roofing tile 11 is installed the undersurface of the pawls 22, make contact with the shingle 3. On the bottom surface of the trough of the S-shaped curve of the tile 11 is provided with flat portion 23.

Further, there are provided a plurality of longitudinal ribs 25 . . . on the bottom surface B of the roofing tile 11. The central longitudinal ribs 25*a* positioned substantially at central-rear area of the bottom surface B are formed obliquely in cross-section; more specifically they gradually decrease in height toward the rear edge 11*a* so that their undersurfaces may contact with the single 3, supporting the roofing tile 11 when it is installed.

In the central area of the bottom surface B of the roofing tile 11 are further provided with a plane portion 26 and shorter longitudinal ribs 25*b*; the ribs 25*b* are positioned at the both sides of the plane portion 26 and are designed comparatively high and short. The above-mentioned plane portion 26 and shorter longitudinal ribs 25*b* are provided in order that they may contact with a crosspiece to support the roofing tile 11. It should be noted that a cross-piece is not normally required in a roofing work, but is in particular cases employed by being nailed to a shingle at regular intervals. The central longitudinal ribs 25*a*, on the other hand, also may support the tile 11 by being their ends caught by the cross-piece, preventing the tile 11 from slipping down. The reference numerals 27*s* in FIG. 2 denote cut-away portions formed on the longitudinal ribs 25 . . . ; said cut-away portions 27*s* prevents the longitudinal ribs 25 . . . from being cracked when the roofing tile 11 shrinks during a manufacturing process thereof.

On the front edge 11*b* and the rising side edge 11*d* of the bottom surface B of the roofing tile 11 are respectively provided with flanges 29, 30, which form a drain and extend vertically downward in a fixed height.

Along the front edge flange 29 is provided with a stepped surface 31 having a shape of saw-tooth in cross-section to prevent rainwater from flowing up; while along the rising side edge flap 30 is provided with a shallow groove 32 having a fixed width. Further, along the stepped surface 31 is provided with a receiving groove 33 into which the rear edge flange 12 of a subjacent tile 11' may be inserted. There is also provided a lateral rib 35 along the receiving groove 33; the height of the lateral rib 35 is so determined that the front side of the lateral rib 35 may contact with the back side of the rear edge flange 12 of the subjacent tile 11'. At substantially both ends of the lateral rib 35 are provided inlaying projections 36 so that they may be engaged with the engaging recesses 15 provided on the rear edge flange 12 of the subjacent tile 11' when the roofing tiles are installed.

Incidentally, it should be noted from FIGS. 4 to 6 that the contact-relation between the upper surface of the rear edge flange 12 of the subjacent tile 11' and the bottom surface of the receiving groove 33 is designed such that at the trough of the roofing tiles, which is the area rainwater is liable to flow up, they contact tightly with each other, but a clearance appears between them and gradually increases toward both sides of the tiles longitudinally regularized. The above relation is adopted in order to prevent the roofing tile from being twisted during its manufacturing process.

The reference numerals 37*s* shown in FIG. 2 are, incidentally, hiding-nail-holes which opens on the bottom surface B but is thinly covered on the top surface A of the tile 11.

The roofing tile 11 in accordance with the present invention is designed as mentioned above and will be installed on a shingle as follows:

The receiving groove 33 of the roofing tile 11 is set on the rear edge flange 12 of the subjacent roofing tile 11', and the front side of the lateral rib 35 of the tile 11 is set to come in contact with the back side of the rear edge flange of the subjacent tile 11'. Each of the inlaying projections 36, 36 provided on the lateral rib 35 is inlayed with corresponding engaging recesses 15 of the subjacent tile 11'.

On the other hand, the rising side flap 30 of the roofing tile 11 is engaged with the shallow groove 16 of a left side adjacent tile (not shown) and the flat side flange 13 of the left side adjacent tile is engaged with the shallow groove of the roofing tile 11. Then the front end of the rising side flap 30 of the tile 11 is engaged with the recess 20 of the subjacent tile 11'.

While keeping the above positions, the central longitudinal ribs 25*a*, flat portion 23 and stabilizing pawls 22, 22 are placed on the shingle 3. Thus the roofing work is completed.

Therefore, the roofing tile 11 is kept paralleled with the subjacent tile 11' since the lateral rib 35 firmly contacts with the rear edge flange 12 of the subjacent tile 11'. Further, by engaging the inlaying projections 36 of the tile 11 with the engaging recesses 15 of the subjacent tile 11' by making lateral adjustment, the longitudinal relation between the tiles 11 and 11' is regularized. Furthermore, the engagements of the rising side flap 30 with shallow groove 16 and of the flat side flange 13 and the shallow groove 32 make the roofing tiles laterally parallel.

When, during the roofing work, the roofing tile 11 makes the above described contact, engagement and inlay with the subjacent and side adjacent tiles, it produces a snap sound; therefore, the roofer can easily confirm that the tile 11 is placed at correct position.

Thereafter, the roofing tile 11 is fixed on the shingle 3 by being nailed at the nail-hole 21*a* and/or hiding-nail-holes 37. This nailing work is sufficient if it is done every fourth tile.

When the roofing tile 11 is once fixed on the shingle 3, the rear edge 11*a* of the tile 11 becomes to be supported by the stabilizing pawls 22 and the flat portion 23; and substantially the rear half area of the tile 11 becomes to be supported by the central ribs 25*a*. Further, the front edge 11*b* of the tile 11 is supported by the front edge flap 29 and by the rear edge flange 12 of the subjacent tile 11' which is engaged with the receiving groove 33 of the tile 11; the lateral rib 35 of the tile 11 firmly contacts with the rear edge flange 12 of the subjacent tile 11' and the inlaying projections 36 of the tile 11 are inlaid with the engaging recesses 15 of the subjacent tile 11'. Since the tile 11 is installed and fixed in the manner mentioned above by being supported at several points, the load applied on it is distributed to said supporting points and does not act as bending moment; further, the fixed tile 11 is prevented from slipping and is kept being fixed stabily.

In the FIG. 7 is shown another embodiment of the present invention which is modified partially. The roofing tile 11 of FIG. 7 is substantially the same in construction as the previously described roofing tile except that the inlaying projections 36' provided on the lateral rib 35 are so designed that the front side thereof gradually projects toward the front of the tile 11, forming backward-declined surfaces 36'*a*.

The roofing tile 11 of the above embodiment is installed in such a manner that the backward-inclined surfaces 36'*a* of the inlaying projections 36' engage with the backward-inclined surfaces 15*a* of the engaging recesses 15 provided on the rear edge flange 12 of the subjacent tile 11'.

Therefore, the roofing tile 11 is correctly positioned and is able to oppose securely the force which acts upwardly to strip the tile 11 off; accordingly, the tile 11 is prevented from being blown away.

Figure 8:
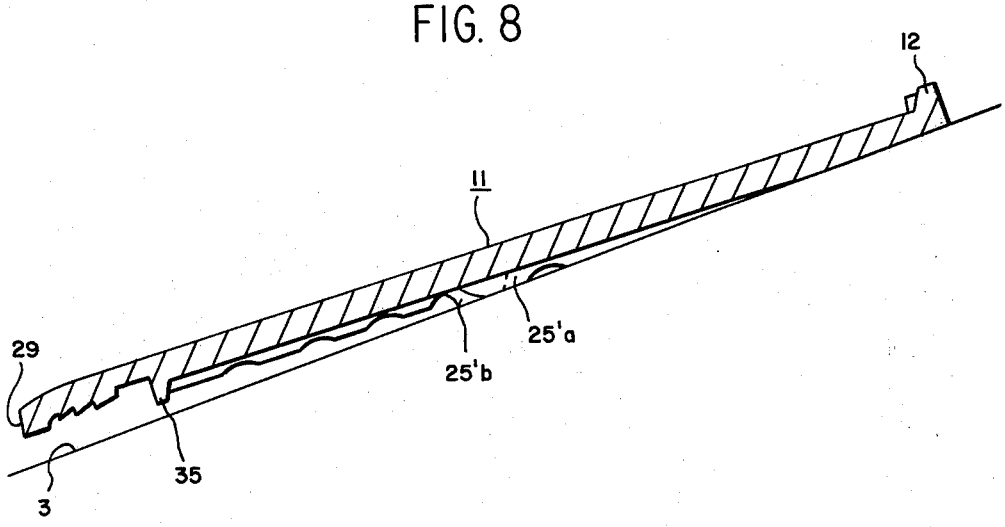
FIG. 8 is a cross-sectional view showing another embodiment of this invention.
Figure 9:
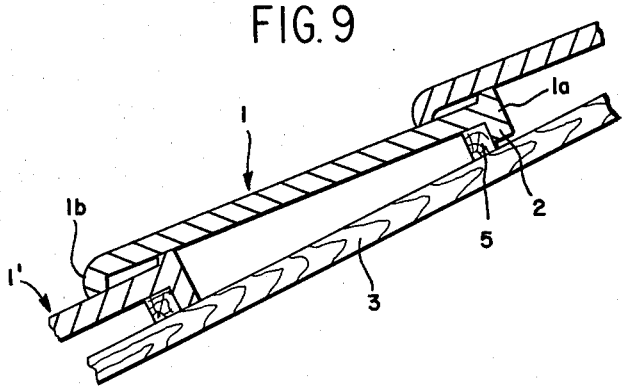
FIG. 9 is a cross-sectional view of a roofing tile in prior art.

The further modified embodiment of the present invention will be hereunder explained in accordance with FIG. 8.

In the previously-mentioned embodiment, the central longitudinal ribs 25*a* are cut off to allow the plane portion 26 to be formed and shorter longitudinal ribs 25*b* in order that the roofing tile 11 may be installed even in the case wherein a cross-piece is used in a roofing work. However, the cross-piece is normally not used in the roofing work. In the embodiment of FIG. 8, therefore, the central longitudinal ribs 25'a are provided continuously without being cut off and the plane portion 26 is not formed.

Namely, the central longitudinal ribs 25'a are formed to increase gradually in height toward the front edge of the tile 11, to the extent of not giving a difficulty to its configuring process. Therefore, because of above described shape, the central longitudinal ribs 25'a may support the central and front area of the tile 11 by contacting with the shingle 3.

Further, the shorter longitudinal ribs 25'b are formed higher than those of the previously mentioned embodiments to be able to contact with the shingle 3 at both sides of the central areas of the tile 11. Therefore, the roofing tile 11 is stabily supported at its central area by the shorter longitudinal ribs 25'b in almost the same manner as the stabilizing pawls 22 which support the central-rear edge areas of the tile 11.

From the description, it should be apparent that the roofing tile provided by this invention has the following advantages:

The roofing tile 11 is provided at is rear edge 11a with stabilizing pawls 22 at a fixed space from each other and is also on its bottom surface B provided with a plurality of longitudinal ribs 25 . . . so that when the tile 11 is installed said stabilizing pawls 22 and longitudinal ribs 25 . . . , more specifically at least rear side portion thereof, come in contact with the shingle 3 to support the tile 11. Therefore, even a great amount of load is applied on the tile 11 as in the case one steps thereon, the load is distributed to the points by which the tile 11 is being supported. As a result, a bending moment may be prevented from being given to the tile 11 and the tile 11 is therefore prevented from cracking. The stabilizing pawls and longitudinal ribs also prevent the roofing tile from moving above even when one steps on the side part area of the tile to give it excessive load. Therefore, the tiles regularly installed are not disordered.

On the other hand, the roofing tile of the present invention is so designed that the lateral rib 35 is provided along the front edge 11b of the bottom surface B of the tile 11 and further the inlaying projections 36 and the receiving recesses 15 therefor are respectively provided on the lateral rib 35 and the rear edge flange 12 such that the lateral rib 35 may tightly contact with the rear edge flange of a subjacent tile and the inlaying projections 36, 36 may be also firmly inlaid with the receiving recesses 15 of a subjacent tile. Consequently, the roofing tile 11 may be easily positioned and once installed it is not disordered longitudinally or laterally; and further, since no cross-piece is required in the roofing work, leakage of rainwater which might occur at nail holes for fixing the cross-piece is prevented; the roofing work may be done accurately in a shorter amount of without requiring higher roofing skill.

More specifically, the roofing tile 11 is so designed as to its rear edge 11a is placed on the shingle 3 directly, that is, without using cross-pieces therebetween; consequently, the stabilizing pawls 22 may be formed so as to contact with the shingle 3 in a fixed space without forming it large enough to make the pawl configuring process difficult, and also the longitudinal ribs 25 . . . may be provided so as to make contact with the shingle 3 without forming large.

Further, since the longitudinal ribs 25 . . . and lateral rib 35 act to reinforce the roofing tile 11, the thickness of the tile may be fairly reduced, saving the material cost and fuel cost which is required for burning the tile and less costing for the tile manufacturing as well as making roofing work easier.

Further, since the lateral rib 35 of the roofing tile 11 contacts firmly with the rear edge flange 12 of the subjacent tile, the wind which might blow into from the gap between the front edge flap of the tile 11 and top surface A of the subjacent tile is shut out at said contact portion, preventing the rainwater from flowing up; as a result, leakage of rainwater is prevented.

Furthermore, since the embodiment of FIG. 7 is so designed that the inlaying projections 36' and the engaging recesses 15' which are to be inlaid with each other has respectively backward-inclined surfaces 36'a and 15a which act to prevent the tile 11 from moving above, the tile may oppose to the force which might be applied in the direction to remove the tile; therefore, the tiles are prevented from being blown off even by strong wind, such as typhoon or hurricane.

I claim:

1. A roofing tile which is generally rectangular in plan view and S-shaped in cross-section, said tile comprising:

an upwardly projecting, lateral, top end flange provided on a top surface of said tile;

at least one engagement recess provided in said top end and said top end flange;

at least a pair of stabilizing pawls provided on a bottom surface of said tile adjacent said top end, each of said stabilizing pawls provided on each side of a trough of said S-shaped cross-section, said stabilizing pawls for engaging with a surface of a roofing tile support;

a plurality of first longitudinal ribs provided on said bottom surface of said tile adjacent said top end of said tile for engaging with said surface of said roofing tile support and for reinforcing said tile;

a plurality of second longitudinal ribs provided on said bottom surface of said tile adjacent a bottom end of said tile for reinforcing said tile;

a lateral rib provided on said bottom surface of said tile adjacent said bottom end, said lateral rib for engaging with an upwardly projecting, lateral, top end flange of a subjacent tile;

at least one projection provided on said lateral rib, said projection for engaging with an engaging recess of said subjacent tile;

a first longitudinal groove provided in said top surface of said tile adjacent one edge of said tile;

a first longitudinal, upwardly projecting flange provided adjacent said first longitudinal groove;

a second longitudinal groove provided in a bottom surface of said tile adjacent another edge of said tile for engaging with a first longitudinal, upwardly projecting flange provided on an adjacent tile;

a second longitudinal, downwardly projecting flange provided on said bottom surface adjacent said second longitudinal groove, said second longitudinal, downwardly projecting flange for engaging with a first longitudinal groove provided in said adjacent tile; and a stepped surface provided along and between said bottom end and a lateral rib of said subjacent tile;

whereby said tile may be installed without utilizing cross-pieces.

2. A roofing tile according to claim 1 wherein said engaging recess and said projection are each provided with inclined engaging surfaces.

3. A roofing tile according to claim 2 further comprising a plane portion provided on said bottom surface of said tile subjacent to said trough of said S-shaped cross-section and wherein said first and second longitudinal ribs provided adjacent said plane portion are shorter in height than the first and second longitudinal ribs located further from said plane portion.

* * * * *